US009434053B2

(12) United States Patent
Selkowitz

(10) Patent No.: US 9,434,053 B2
(45) Date of Patent: Sep. 6, 2016

(54) GAS CYLINDER COMPRESSION TOOL

(71) Applicant: Stephen L. Selkowitz, Bakerstown, PA (US)

(72) Inventor: Stephen L. Selkowitz, Bakerstown, PA (US)

( * ) Notice: Subject to any disclaimer, the term of this patent is extended or adjusted under 35 U.S.C. 154(b) by 0 days.

(21) Appl. No.: 14/611,293

(22) Filed: Feb. 2, 2015

(65) Prior Publication Data

US 2015/0266140 A1 Sep. 24, 2015

Related U.S. Application Data

(60) Provisional application No. 61/955,847, filed on Mar. 20, 2014.

(51) Int. Cl.

| | |
|---|---|
| ***B25B 1/22*** | (2006.01) |
| ***B25B 5/10*** | (2006.01) |
| ***B25B 5/08*** | (2006.01) |

(52) U.S. Cl.

CPC ..... *B25B 5/101* (2013.01); *B25B 5/085* (2013.01); *B25B 5/102* (2013.01); *Y10T 29/4973* (2015.01)

(58) Field of Classification Search

CPC ..... B25B 5/082; B25B 5/067; B25B 5/125
See application file for complete search history.

(56) References Cited

U.S. PATENT DOCUMENTS

| | | | | | |
|---|---|---|---|---|---|
| 2,114,227 | A * | 4/1938 | Kriss | B25B 5/101 | 269/143 |
| 2,236,913 | A * | 4/1941 | Merrill | B23K 11/004 | 138/99 |
| 2,549,256 | A * | 4/1951 | Sparling | B25B 5/101 | 269/223 |
| 3,224,752 | A * | 12/1965 | Benbow | B25B 5/125 | 269/249 |
| 3,596,898 | A * | 8/1971 | Hilburn | B23K 37/0533 | 269/243 |
| 3,836,136 | A | 9/1974 | Davis | | |
| 4,032,109 | A | 6/1977 | Wilson | | |
| 4,363,475 | A * | 12/1982 | McCarty | B25B 5/006 | 269/101 |
| 5,722,649 | A | 3/1998 | Morris | | |
| 7,895,723 | B2 | 3/2011 | Wridt et al. | | |
| 8,025,279 | B2 | 9/2011 | Seber | | |
| 8,282,088 | B2 | 10/2012 | Janson et al. | | |
| 8,505,892 | B2 * | 8/2013 | Seidel | B25B 5/003 | 269/249 |
| 8,813,326 | B2 * | 8/2014 | Zychowski | B25B 27/30 | 269/3 |
| 8,833,747 | B2 | 9/2014 | Cusumano | | |
| 8,894,055 | B2 | 11/2014 | Marrinan et al. | | |
| 2015/0266140 | A1 * | 9/2015 | Selkowitz | B25B 5/101 | 29/402.08 |

OTHER PUBLICATIONS

Lapeer Manufacturing Company, Knu-Vise brochure, Aug. 12, 2002, p. 83, Lapeer, Michigan, US.

* cited by examiner

*Primary Examiner* — Lee D Wilson
(74) *Attorney, Agent, or Firm* — McKay & Associates, PC

(57) ABSTRACT

A compression tool suited for aiding the installation of gas cylinders, especially for the underside of fold-and-roll tables. The tool comprises a generally C-shaped clamp subassembly having a lower jaw, an upper jaw, and an arm. A spindle is connected through the upper jaw, the spindle having a spindle lower end. An upper channel member, preferably U-shaped, is connected to the spindle lower end, the upper channel member configured to travel axially along the spindle and engage a first eyelet of a gas cylinder. A lower channel member, also preferably U-shaped, is connected to an outer end of the lower jaw in alignment with the upper channel member, the lower channel member configured to engage an opposing, second eyelet of the gas cylinder, wherein the gas cylinder is compressed and secured within the clamp subassembly and immobilized for installation.

7 Claims, 4 Drawing Sheets

GAS CYLINDER COMPRESSION TOOL

CROSS-REFERENCE TO RELATED APPLICATIONS

The instant application claims benefit of provisional application Ser. No. 61/955,847, filed Mar. 20, 2014, the contents of which are incorporated herein by reference.

BACKGROUND

Fold-and-roll tables are designed to fold upward into a transportable position, rolled and stored for multipurpose room usage. Such tables typically are used within schools, cafeterias and conference facilities where variable events are held which require movement or removal of the tables. These types of tables are also frequently moved for floor cleaning and other maintenance.

Because fold-and-roll tables are long and heavy, the tables are typically implemented with pneumatic cylinders to aid in the folding and unfolding process. Without the cylinders the tables would unsafely and violently fall towards the floor. The cylinders also aid in the process of lifting the tables to their upright, sto-away position.

As is known, the cylinders have two ends, each anchored on various locations on the underside of the table. Each end includes an eye receptacle for accepting a nut and bolt attachment. One end may attach to the under-table frame cross bar, and the other end of the cylinder attaching to the table leg portion for leg assembly retraction.

Over time the cylinders must be replaced. They are typically replaced by maneuvering the table to a partially folded or teepee-like position, when the underside of the table is more accessible and when the cylinders are only partially compressed. To hold this table position, safety straps must be used to belt the table. Alternatively, two or more individuals can overturn the table to disassembly the leg assembly. This is very labor intensive and time-consuming.

During the replacement process the new cylinder's length must match the length of the old, in-place cylinder being removed since each cylinder end will reside at the same anchoring point. The instant invention aids in forming the new, replacement cylinder at approximately the same length of the old cylinder and outside the confines of the table underside and efficiently placing the new cylinder at the desired anchoring location, resulting in quick and safe replacement. The instant tool may also be used for any other application which utilizes similar types of gas cylinders such as doors and automotive or other mechanical devices.

SUMMARY

Accordingly, the invention comprehends a compression tool suited for aiding the installation of gas cylinders, especially for the underside of fold-and-roll tables. The tool comprises a generally C-shaped clamp subassembly having a lower jaw, an upper jaw, and an arm. A spindle is connected through the upper jaw, the spindle having a spindle lower end. An upper channel member, preferably U-shaped, is connected to the spindle lower end, the upper channel member configured to travel axially along the spindle and engage a first eyelet of a gas cylinder. A lower channel member, also preferably U-shaped, is connected to an outer end of the lower jaw in alignment with the upper channel member, the lower channel member configured to engage an opposing, second eyelet of the gas cylinder, wherein the gas cylinder is secured within the clamp subassembly and immobilized for installation.

The compression tool further comprises a handle extending from the arm proximate to the upper jaw at an upper end of the C-shaped clamp subassembly, and further included is a tubular extension bar for engaging the handle to aid in leverage. A separate housing is provided including a channel defined by a pair of upstanding guides along a length of the housing such that the gas cylinder can be disposed therein to aid in placement of the upper channel member and the lower channel member.

DETAILED DESCRIPTION OF THE PREFERRED EMBODIMENT

Figure 1:
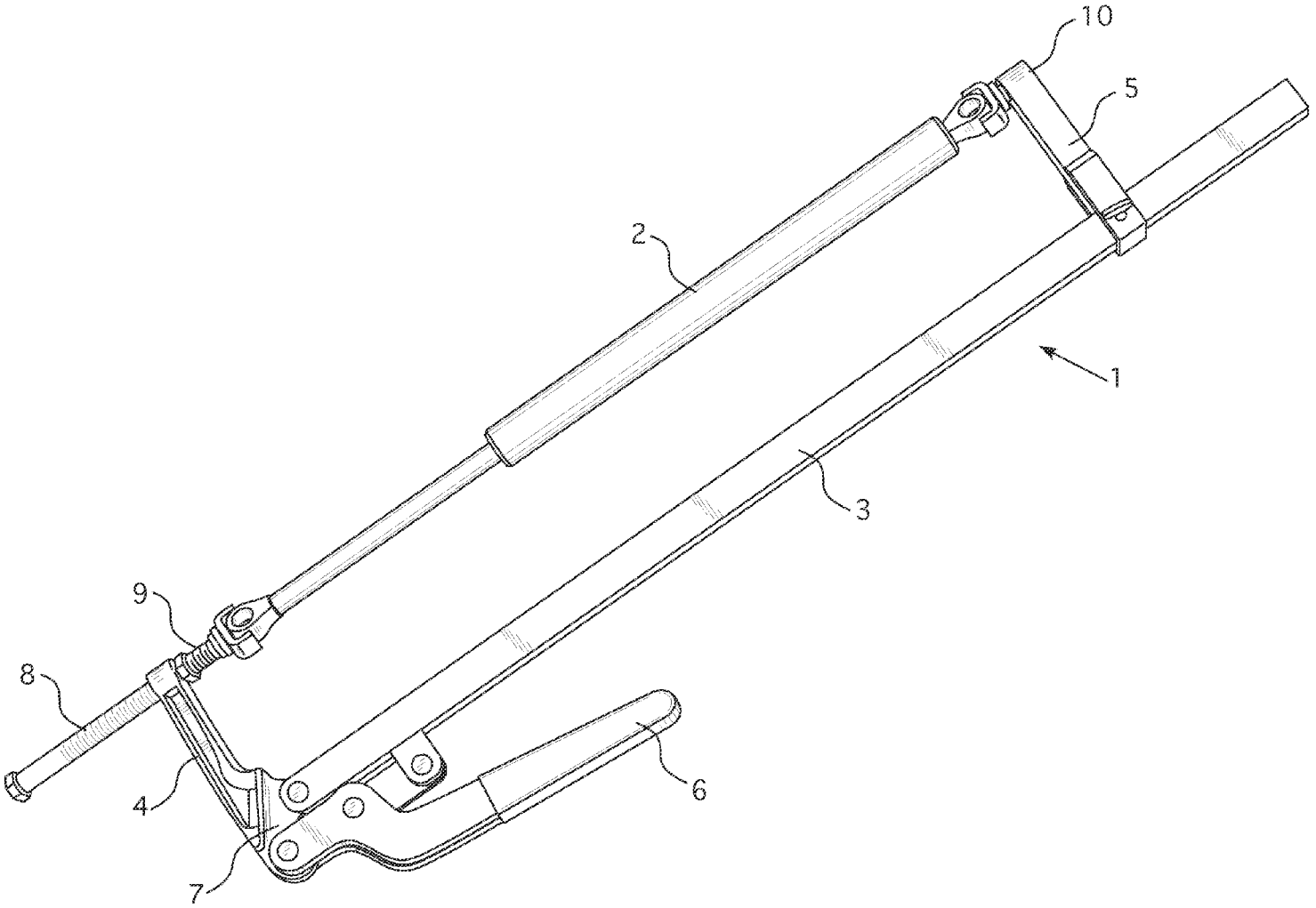
FIG. 1 shows a perspective view of the instant tool clamp subassembly engaging the pneumatic cylinder.
Figure 2:
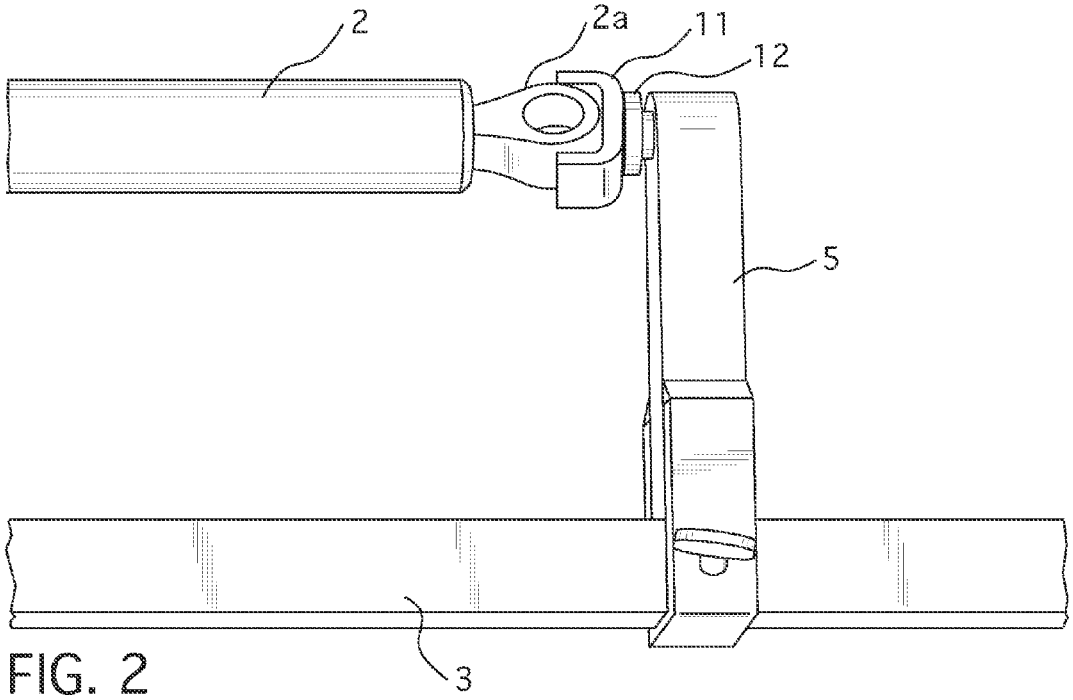
FIG. 2 shows a perspective view of a close-up of the bottom end of the clamp subassembly.
Figure 3:
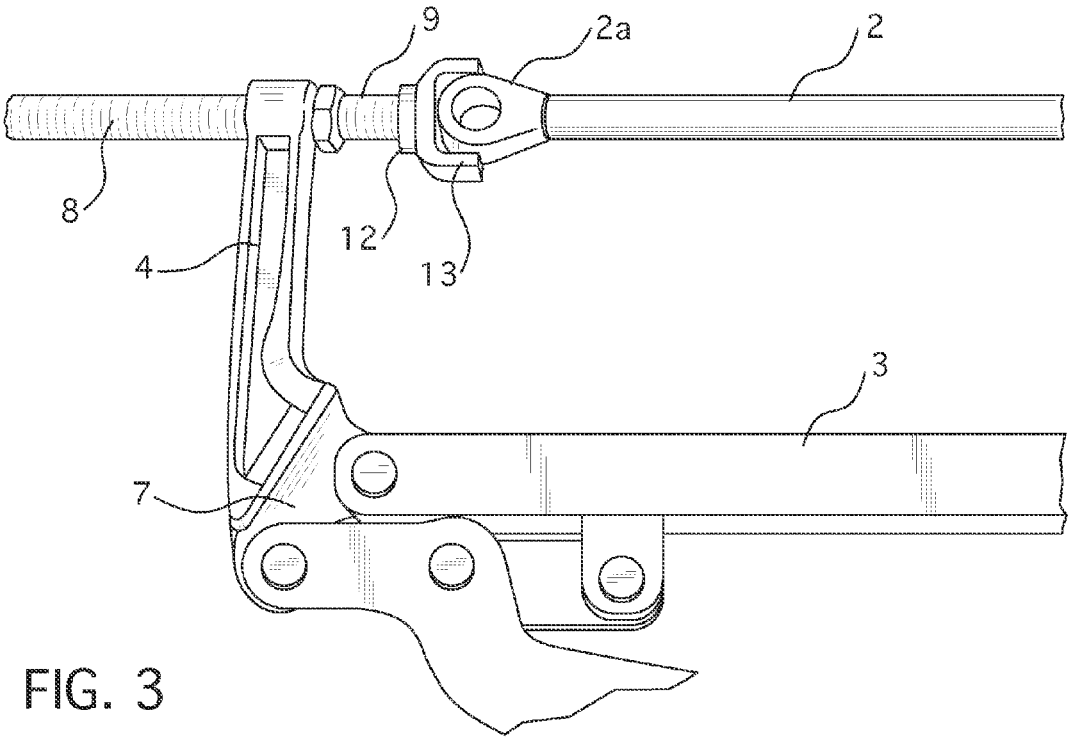
FIG. 3 shows a perspective view of a close-up of the top end of the clamp subassembly.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the a mode of practicing the invention.

Referencing then FIGS. 1-6, shown is the instant tool comprising generally two subassemblies, namely a clamp subassembly 1 and a housing subassembly, or housing 16.

Shown is the clamp subassembly 1 having a gas cylinder 2 disposed therein in a secured position. A gas cylinder 2 means any type of pressurized cylinder, strut, or piston used to provide resistance, for example with any device that opens and closes such as a door or table. Shown herein as an example only is the use of the instant tool for the underside of a fold-and-roll table gas cylinder. Such cylinders can range from 95-220 lbs of compression rating. Therefore, the instant tool is adapted to compress a gas cylinder 2 and maintain the gas cylinder 2 in a fixed position while the entire implement with the gas cylinder 2 is located at the desired position such that the gas cylinder 2 can replace an already mounted, pre-existing cylinder efficiently and safely.

Clamp subassembly 1 is generally C-shaped to include an elongate arm 3, an upper jaw 4, and a lower jaw 5. "Generally" C-shaped means the upper jaw 4 and lower jaw 5 extend from the arm 3 as would be typical for a C-clamp device, but the arm 3 need not be linear nor do each jaw have to be linear and perpendicular to arm 3, although preferred. A handle 6 can be disposed at any location along arm 3 or upper jaw 4 to aid in maneuvering the clamp subassembly 1. The desired type of handle 6 as shown is a lock-tight type handle 6 which raises or lowers the upper jaw 4 and upon lowering "locks" the upper jaw 4 in its down-most position. Upper jaw 4 extends from upper end 7 of arm 3. A spindle 8 is configured to move vertically through upper jaw 4 and is disposed through upper jaw 4 as shown, the spindle lower end 9 of spindle 8 configured to engage one end of the gas cylinder 2. For example, the spindle 8 is threadedly connected through a hole defined in upper end 7 such that upon manually rotation of the spindle 8 the spindle 8 travels up or down and thus "axially" in relation to arm 3 through the hole as would be understood.

Lower jaw 5 is disposed along arm 3 distal to upper jaw 4, extending therefrom similarly to upper jaw 4 with its length of extension substantially similar to the length of upper jaw 4 so as to have its lower jaw 5 outer end 10 substantially aligned with spindle 8 of upper jaw 4. Lower jaw 4 may include an adjustment means for sliding lower jaw 5 up and down (axially) along arm 3, thus being movably positioned along arm 3 to vary the length between spindle lower end 9 and the lower jaw outer end 10 in large increments. Accordingly, gas cylinder 2 can be placed within and movably fixed between upper jaw 4 and lower jaw 5 as shown.

The tower jaw 5, described in more detail, includes a lower channel member 11 disposed at lower jaw outer end 10. Lower channel member 11 is mounted to lower jaw outer end 10 in one embodiment using a screw such that lower channel number 11 can be raised or lowered slightly in small increments. Further shown is how lower channel member is sized to have accommodated therein one eye receptacle of the gas cylinder 2. In the preferred embodiment the lower channel is U-shaped such that its extended portions can engage the eyelet in a cup-like fashion. However, it is not critical that lower U-channel be precisely "U" shaped as shown in the preferred embodiment. However, it is critical that it not be flat, thus of a shape which provides for any means to forcibly abut the eye receptacle while enveloping the eyelet in some manner, such as a curved plate or cup-like member, which additionally may be case-hardened in any fashion.

The upper jaw 4, described in more detail, includes a similar upper channel member 13 disposed at spindle lower end 9. Spindle 8 is formed as an elongate bolt or any type of threaded, cylindrical pin adapted to travel through upper jaw outer end 10. Upper channel member therefore travels with spindle lower end 10. In a preferred embodiment both the upper and lower channel members 11, 13 are attached to their respective locations loosely or with a free spin attachment so that bolt can be tightened or loosened for fine adjustments or moved to match the angle of each cylinder eyelet rather than move the eyelet 2*a* itself to align with a static U-channel. In either embodiment, shown is how upper channel member 13 is sized (similarly to lower channel member 11) to have accommodated therein the opposing eye receptacle or eyelet 2*a* of the gas cylinder 2 to thereby confine the gas cylinder 2. As with the lower channel member 11, it is not critical that upper channel member 13 be precisely U-shaped as shown in the preferred embodiment. However, it is critical that it not be flat, thus of a shape which provides for any means to forcibly abut the eyelet 2*a* while enveloping the eyelet 2*a* in some manner, such as a curved plate or cup-like member, which additionally may be case-hardened in any fashion.

Figure 6:
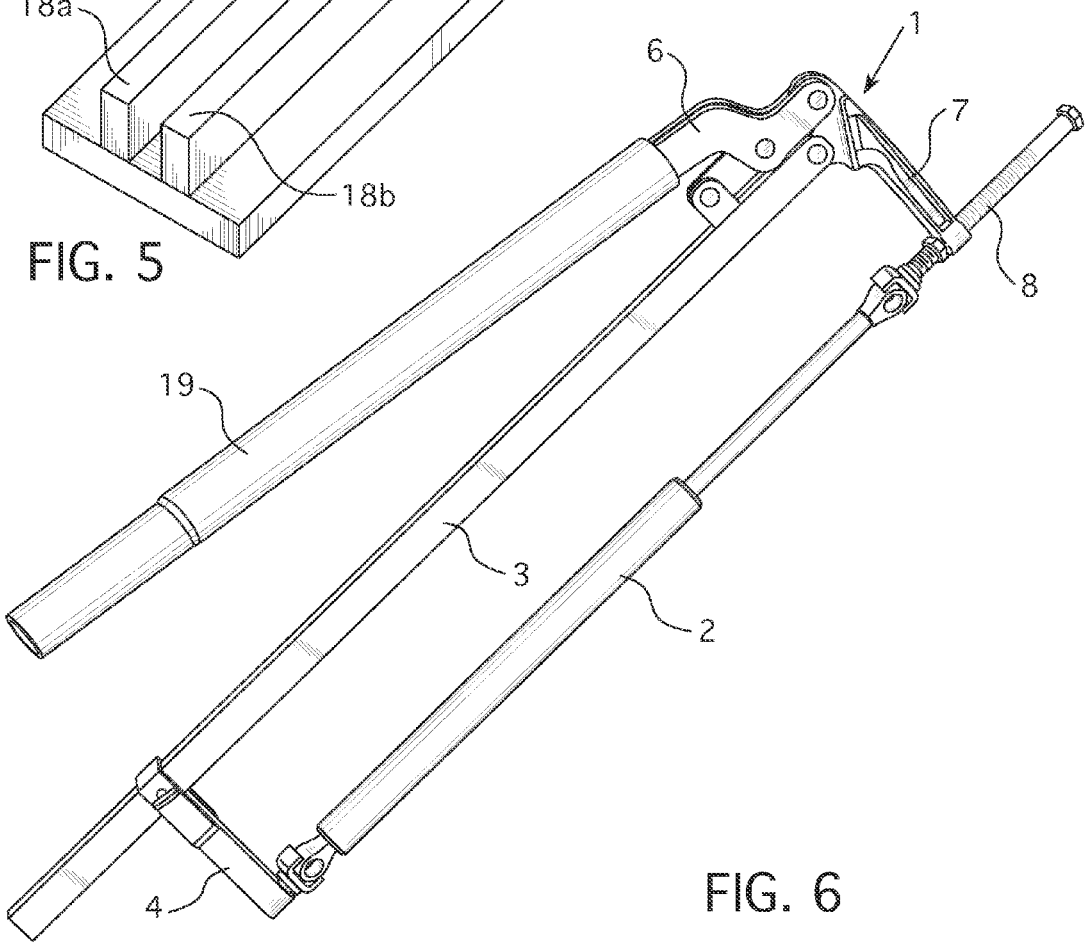
FIG. 6 shows a perspective view of the clamp subassembly including an elongate extension bar.

FIG. 6 shows an embodiment wherein a leveraging extension bar 19 can be utilized with the handle 6 for increasing leverage.

Figure 5:
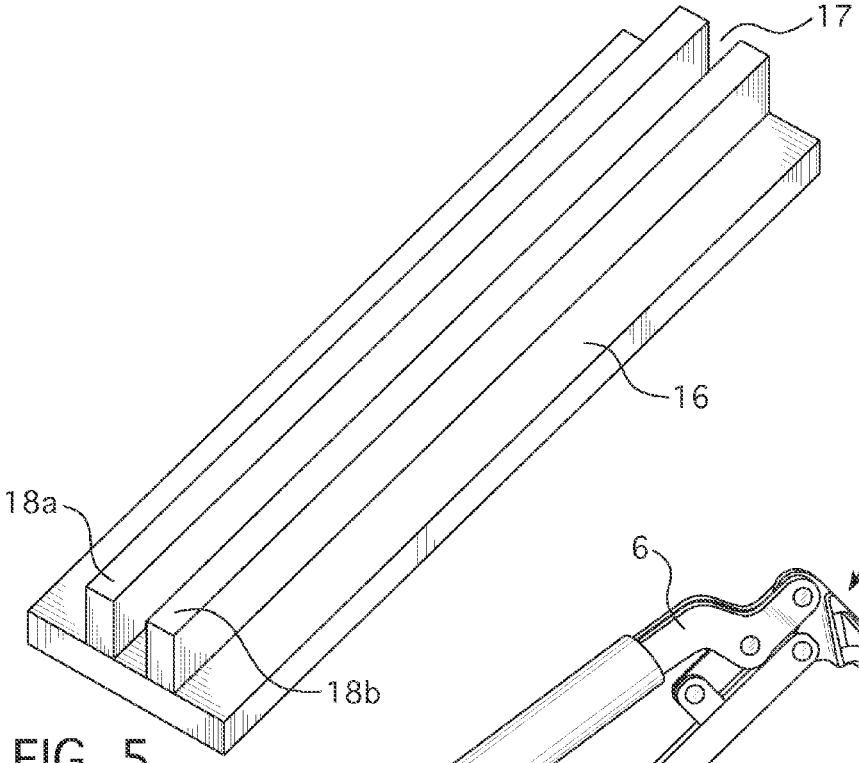
FIG. 5 shows a perspective view of a housing subassembly which can be used in conjunction with the clamp subassembly.

Now referencing FIG. 5, shown next to clamp subassembly 1 is housing 16. Housing 16 is a means for immobilizing the cylinder 2 as it is clamped by clamp subassembly 1. Defined on housing 16 is housing channel 17, for instance two raised, generally parallel guides 18*a*, 18*b* up-stand from a base, i.e. along a length of the housing 16. The gas cylinder 2 is placed within the housing channel 17. The guides 18*a*, 18*b* therefore maintain the cylinder 2 in a relatively stationary position. In this manner, the clamp subassembly 1 can be more easily and accurately secured to each eye receptacle or eyelet 2*a* of the cylinder 2, which expectedly could roll around and move about a flat surface if merely placed thereon.

Figure 4:
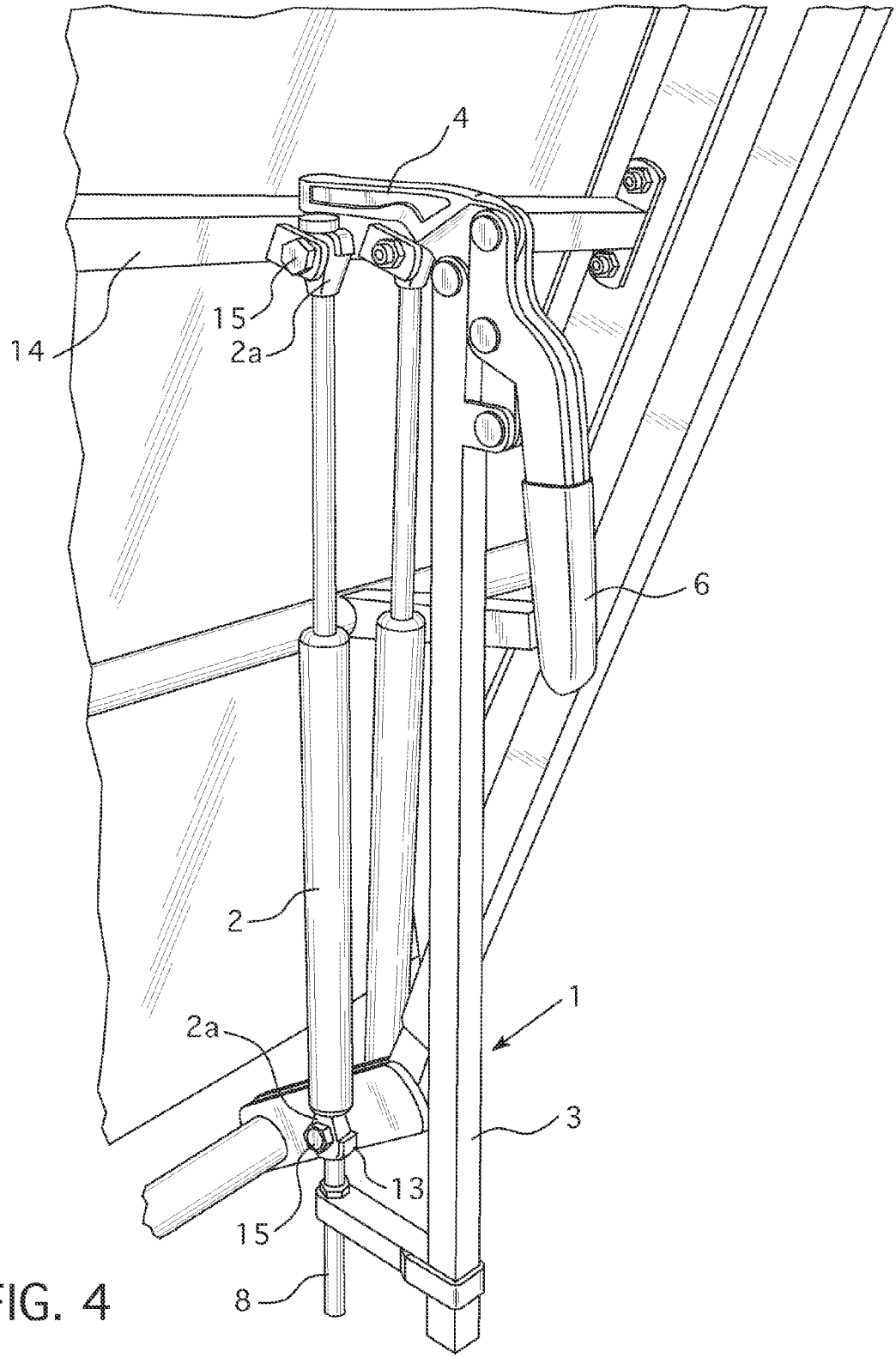
FIG. 4 shows a perspective view of the clamp subassembly in use at the underside of the fold-and-roll table.

In use and with particular reference to FIG. 4, described herein is a method for replacing a gas cylinder 2 at an underside of a table 14, summarized by the steps of: measuring a length of an installed gas cylinder; removing the installed gas cylinder; setting a clamp 1 on a new gas cylinder 2, wherein the clamp 1 is set to approximately the length of the installed gas cylinder obtained from the step of measuring; moving the clamp 1 with the new gas cylinder 2 engaged thereto to the underside of the table 14; while still engaged to the clamp 1, bolting the new gas cylinder 2 to the underside of the table 14; and, releasing the clamp 1 from the new gas cylinder 2, as a result leaving the new gas cylinder 2 at the underside of the table 14.

More particularly, the fold-and-roll table 14 is positioned such that the underside is slightly upright or otherwise made accessible, revealing the old, in-place cylinder, i.e. the "installed" gas cylinder. The length of the installed cylinder is measured in-situ, in its compressed position, for example the length between the bolted-in eyelet 2*a* receptacles which are mounted to the table's mounting holes. The old cylinder is removed. The clamp subassembly 1 with its handle 6 in a downward position is set with its U-channels (channel members 11, 13) spanning a distance which approximates the measurement. The clamp's handle 6 is then released to unlock the clamp 1. The new cylinder 2 to replace the old cylinder is placed on a flat surface, preferably within housing 16. The clamp subassembly 1 with its handle 6 in an up position is placed over the new cylinder 2 and engages the new cylinder 2 by way of the handle 6 of the clamp 1 being pushed downward to "lock" the cylinder 2 between the U-channels 11, 13. The handle 6 of clamp 1 pushing down therefore forcibly compresses the cylinder 2 to the same measurement as previously noted for the old cylinder. The clamp 1 with the compressed cylinder 2 therein is then taken to the installation location and still while within the clamp the eyelets 2*a* of the new cylinder 2 are aligned with the same mounting holes of the table's underside. The length of the new cylinder 2 can be finely adjusted using the adjustment bolts if need be. The cylinder 2 is then fastened using bolts through the eyelets 2*a*, and the clamp 1 is released, leaving the newly mounted, replacement cylinder 2, replaced without having to jostle and maneuver the entire table 14, without requiring two individuals, and without having to compress or maneuver the new cylinder 2 at the confined and potentially dangerous mounting location underneath the table 14.

I claim:

1. A compression tool, comprising:

a generally C-shaped clamp subassembly having a lower jaw, an upper jaw, and an arm;

a spindle connected through said upper jaw, said spindle having a spindle lower end;

an upper channel member connected to said spindle lower end, said upper channel member configured to travel axially with said spindle and engage a first eyelet of a gas cylinder;

a lower channel member connected to an outer end of said lower jaw in alignment with said upper channel member, said lower channel member configured to engage an opposing, second eyelet of said gas cylinder, wherein said gas cylinder is secured within said clamp subassembly and immobilized for installation; and, a handle extending from said arm proximate to said upper jaw at an upper end of said C-shaped clamp subassembly.

2. The compression tool of claim 1, further comprising a tubular extension bar for engaging said handle.

3. The compression tool of claim 1, further comprising a housing, said housing including a housing channel defined by a pair of upstanding guides along a length of said housing such that said gas cylinder can be disposed therein to aid in placement of said upper channel member and said lower channel member.

4. The compression tool of claim 1, further comprising a free spin attachment connected to each said upper jaw and said lower jaw.

5. The compression tool of claim 1, wherein said upper channel member is U-shaped.

6. The compression tool of claim 1, wherein said lower channel member is U-shaped.

7. The compression tool of claim 1, wherein said lower jaw is adjustable along a length of said arm.

* * * * *